US006018930A

United States Patent [19]

Rimondi et al.

[11] Patent Number: 6,018,930

[45] Date of Patent: Feb. 1, 2000

[54] DEVICE FOR AUTOMATICALLY VARYING THE ACTIVE SURFACE OF THE ELEVATOR OF A PACKAGING MACHINE

[75] Inventors: Renato Rimondi, Bazzano; Angelo Cappi, Vignola, both of Italy

[73] Assignee: A.W.A.X. Progettazione E Ricerca S.r.l., Italy

[21] Appl. No.: 09/180,522

[22] PCT Filed: Jul. 29, 1997

[86] PCT No.: PCT/EP97/04120

§ 371 Date: Nov. 9, 1998

§ 102(e) Date: Nov. 9, 1998

[87] PCT Pub. No.: WO98/05556

PCT Pub. Date: Feb. 12, 1998

[30] Foreign Application Priority Data

Aug. 2, 1996 [IT] Italy ..... B096A0425

[51] Int. Cl.[7] ..... B65B 11/06

[52] U.S. Cl. ..... 53/228

[58] Field of Search ..... 53/228, 229, 230, 53/231, 232, 222, 223, 224, 225; 414/618

[56] References Cited

U.S. PATENT DOCUMENTS 4,583,348 4/1986 Treiber et al. ..... 53/441

4,674,269 6/1987 Denda ..... 53/228

5,528,881 6/1996 Cappi et al. ..... 53/441

*Primary Examiner*—John Sipos

*Assistant Examiner*—Steven Jensen

*Attorney, Agent, or Firm*—Larson & Taylor

[57] ABSTRACT

The catches (10) of the brackets (5) which can be made inactive by the elevator when the elevator is in the low position are designed to interact with corresponding cams (20, 21, 22) of different angular extents, keyed to a shaft (17) which is driven by a motor (22) whose speed and phase are electronically controlled and which is supported rotatably by the base of the machine. When a product is fed onto the elevator and its dimensions are measured by known means which then determine the travel of the film unwinding gripper in the packaging station, if necessary the cam shaft is made to rotate through a distance capable of causing the oscillation of the catches of the brackets which are to be disengaged, so that when the elevator rises the unnecessary brackets are already disengaged and oscillate slowly downwards. Immediately after the active travel of the elevator, the cam shaft rotates into the rest position, so that when the elevator is lowered again and causes the previously disengaged brackets to interact with the resetting stops (14) the catches of these brackets are reset so that they retain the brackets in the active position.

7 Claims, 2 Drawing Sheets

DEVICE FOR AUTOMATICALLY VARYING THE ACTIVE SURFACE OF THE ELEVATOR OF A PACKAGING MACHINE

The invention relates to constructional and functional improvements in the elevators of machines for packaging products with stretchable film, particularly in the systems for varying the active surface of the said elevator and adapting it to the dimensions of the products to be packaged. In particular, the improvements in question are suitable for machines of the type described in EP-A-0 569 615 and EP-A-0 619 227 to which the most ample reference will be made.

In order to provide a clearer understanding of the objects of the invention, it will be useful to note briefly that, in the machines referred to, the stretchable film unwound from the reel is held at the leading edge by a comb dispenser interacting with a movable parallel gripper, also in the shape of a comb, which grips the leading edge of the film and moves away from the dispenser to stretch horizontally a portion of the said film, with a length proportional to the dimensions of the product, in the packaging station. The product to be packaged is fed to an elevator which is located under the said horizontal portion of film and which is formed by a plurality of brackets parallel to each other and to the said dispenser and gripper system and on which are disposed oscillating supports, held in the upright position by elastic means. The product rests on these oscillating supports which are made to drop and are made inactive by the lateral grippers holding the lateral flaps of the said portion of film stretched in the packaging station, when these grippers fold the said flaps under the product by entering the support of the product, while the elevator returns to the low position at the correct time to repeat the operating cycle.

To prevent the interference of the elevator with the movable gripper which stretches the said horizontal portion of film in the packaging station, the parallel brackets which form the said elevator are made to be fitted on and projecting from a transverse shaft fixed to the vertically movable element of the elevator, and some of the brackets, facing the said movable gripper, are made to be oscillating on the said shaft and are provided with a catch which, by elastic means, is normally kept in interaction with the tooth of a cam fixed on the said shaft, to keep the corresponding bracket in the horizontal active position. During the rising phase of the elevator, its brackets which would interfere with the said movable gripper feeding the film interact through their catches with a static lock whose position is determined from time to time directly by the said gripper, so that the said catches are released from the corresponding cams and the corresponding brackets oscillate downwards and are thus removed from interference with the gripper located above. In the subsequent downward travel of the elevator, the brackets which have been made inactive in the preceding operating cycle interfere with a fixed stop which returns them to a horizontal position, while the catches are reset to keep the brackets in the active position.

In the practical use of the machine with the elevator designed in the aforesaid way, it was found that the said elevator was subject to undesirable and harmful vibrations when the catches interacted with the said inactivating lock and when the non-working brackets oscillated downwards, especially since this interaction took place at a considerable speed. The invention is intended to overcome this problem with the following idea for a solution. The catches of the brackets which can be made inactive when necessary, when the elevator is in the lower rest position, are designed to be able to interact with corresponding cams of different angular extents, keyed on a single shaft driven by a motor with electronic speed and phase control, and supported rotatably by the base of the machine. When a product is fed to the elevator and known means measure its dimensions and send them to the processor which then determines the travel of the film unwinding gripper in the packaging station, the said processor causes the cam shaft to rotate through an angular distance suitable for the oscillation of the catches of the brackets which are to be made inactive, so that when the elevator is raised the unnecessary brackets are already inactivated and oscillate slowly downwards. The rising and descending movement of the elevator takes place with the correct accelerations and decelerations, so that the disabling of the non-working brackets and their subsequent resetting does not produce harmful vibrations. Immediately after the active travel of the elevator, the said cam shaft returns to the rest position, by a rotation which is the reverse of the preceding rotation, so that when the said elevator returns to the low position and, with a correct deceleration, causes the previously inactivated brackets to interact with the resetting stops, the catches of these brackets return to the active position in which they keep the said brackets in the horizontal position.

Further characteristics of the invention and the advantages derived therefrom will be evident from the following description of a preferred embodiment thereof, illustrated purely by way of example and without restriction by the figures on the two attached sheets of drawings, in which FIGS. 1 and 2 are lateral elevations in partial section of the elevator, in the low position at the start of the cycle and in the raised position with one of the inactivated oscillating brackets respectively;

Figure 1:
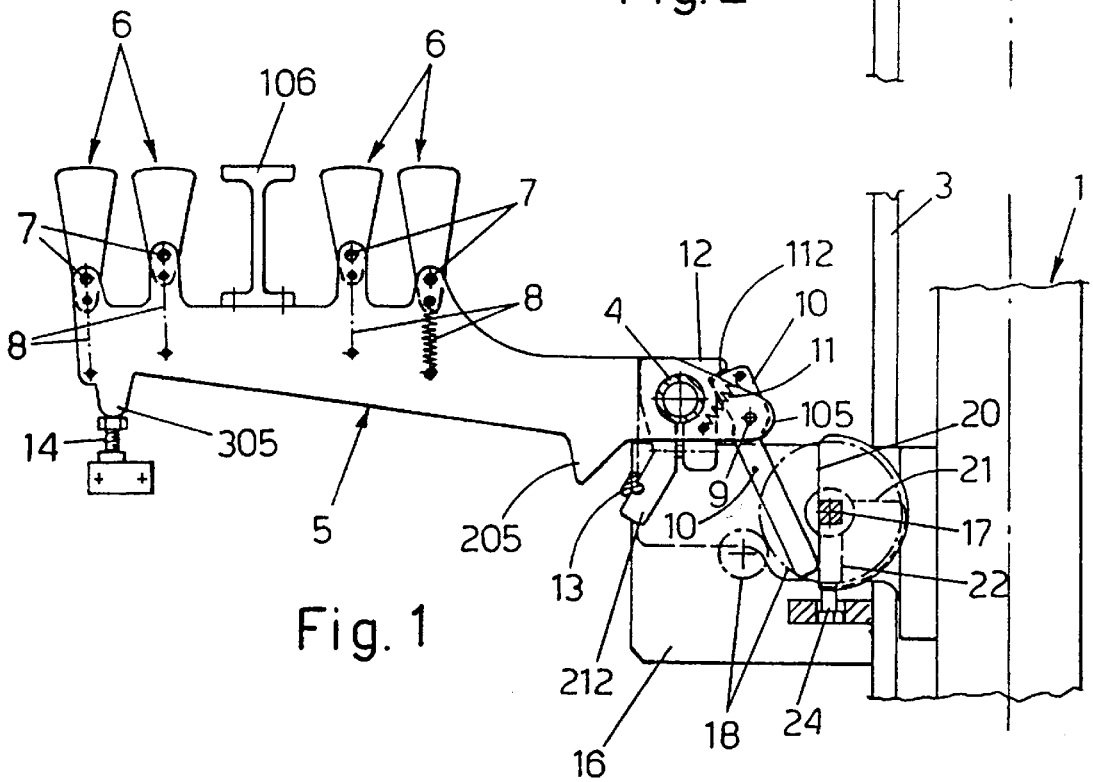
Figure 3:
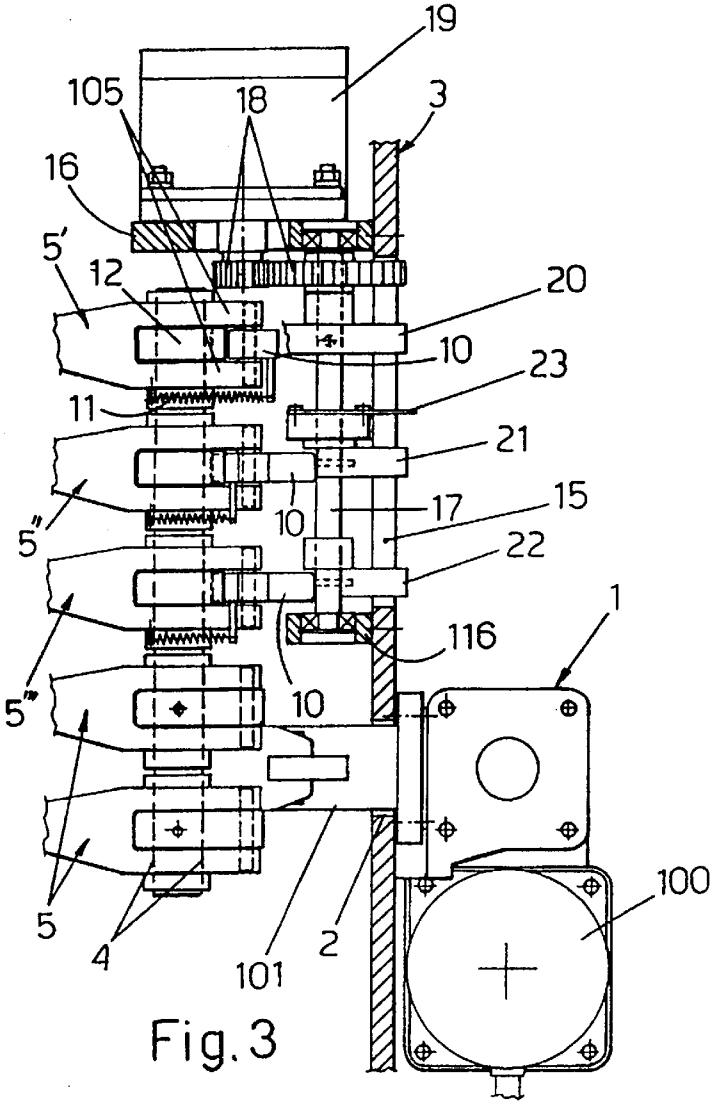

In FIGS. 1 and 3, the number 1 indicates the combination of the guide and vertical slide driven by the motor 100 rotating in both directions with electronic speed and phase control, to which is fixed the arm 101 which projects through a vertical aperture 2 formed in the base structure 3 of the machine, the horizontal shaft 4 supporting the parallel and normally horizontal brackets 5 of the elevator being fixed at one end to, and projecting from, this arm. The brackets are provided with upper supports on which the product rests, and of these supports those indicated by 6 can oscillate on axles 7 parallel to the shaft 4 and are kept in the upright position by a corresponding spring 8, while other central supports 106 are fixed, since they will never engage with the grippers and lateral folders of the packaging machine.

Figure 2:
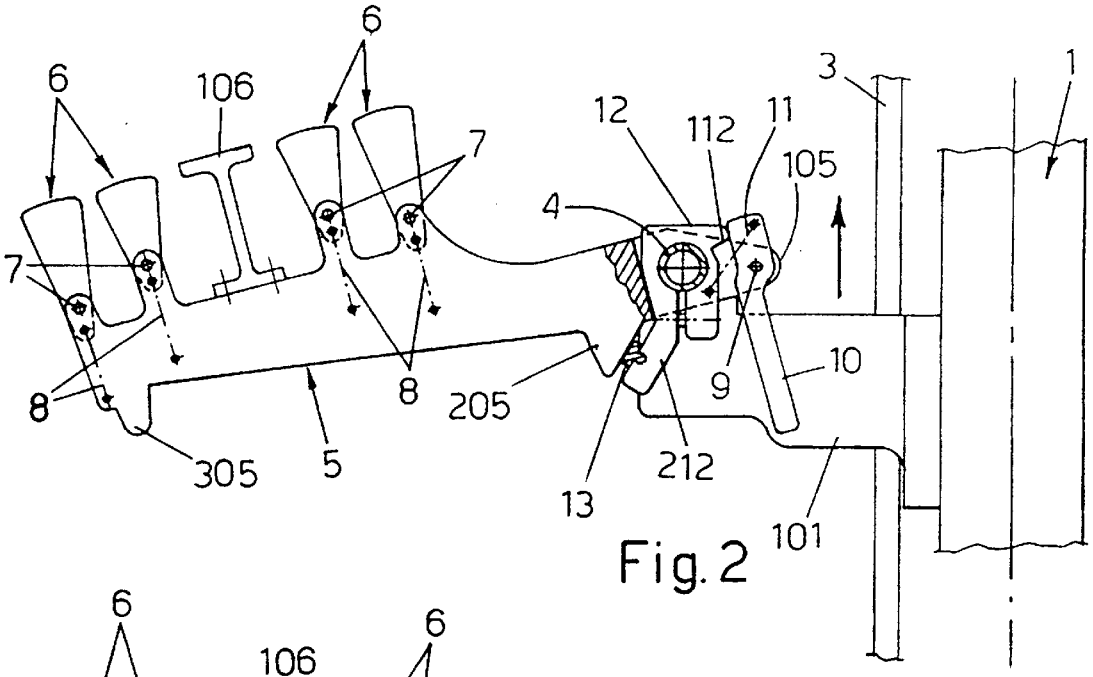

The elevator illustrated by way of example in the drawings is provided with a total of five brackets 5, of which the first two, closer to the end of the shaft 4 supported by the support 101, are fixed to this shaft, while the remaining three are of the aforesaid oscillating type, since when necessary they must be made inactive to prevent interference with the said film feed gripper. These latter brackets are mounted so that each of them oscillates on the shaft 4 with its forked end 105 which extends beyond this shaft and by means of a pivot 9 carries a retaining member or catch 10, the upper end of which is caused by a spring 11 to interact with the cooperating member or tooth 112 of a cam 12 fixed on the portion of shaft 4 located between the arms of the forked end 105 of the bracket in question, and as a result of this interaction the said bracket remains horizontally disposed and in the active position shown in FIG. 1. However, if the catch 10 is removed from the step 112 of the cam 12, when the elevator rises the bracket 5 oscillates downwards and bears with its appendage 205 on a corresponding appendage 212 of the cam 12 which is preferably provided with an elastomeric insert 13 to damp the impact between the two parts, as illustrated in FIG. 2. In these conditions the bracket is inactive. When the elevator then returns to the low position, an appendage 305 of the inactivated bracket interacts with a stop 14 which returns the bracket to the horizontal position as shown in FIG. 1, while the catch 10 returns to interact with the cam 12 to keep the said bracket in the active position.

Figure 5:
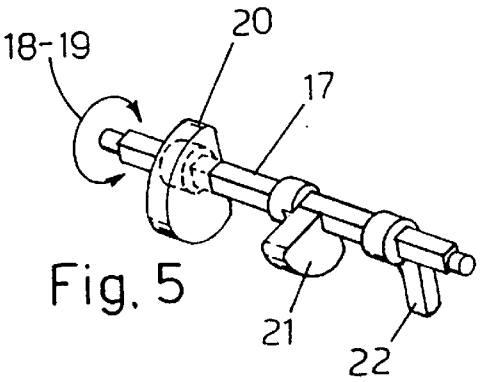
FIG. 5 is a perspective view of the cam shaft of the device according to the invention.
Figure 4:
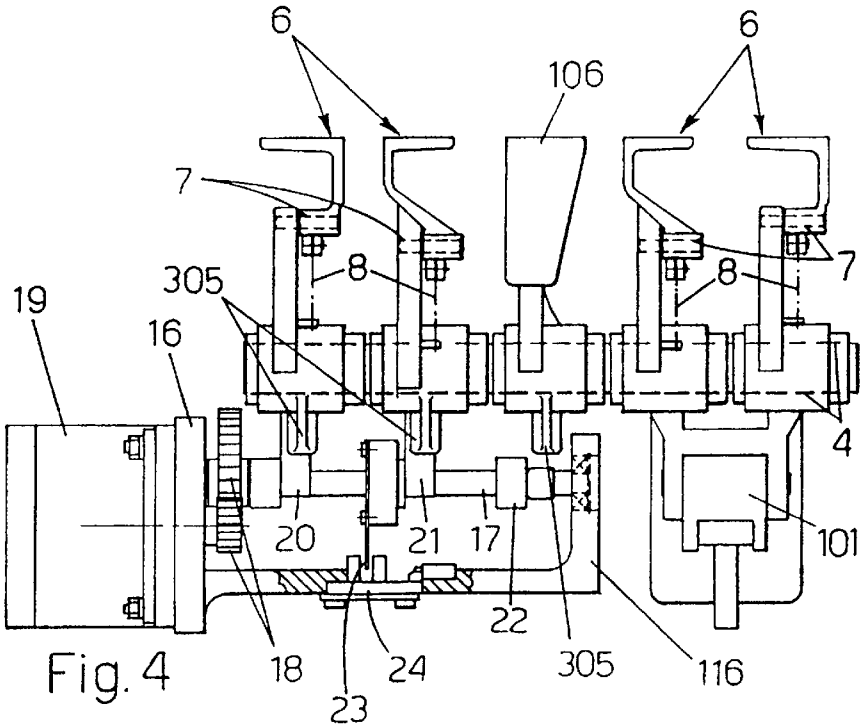
FIGS. 3 and 4 are views of the innovative parts of the elevator, in a plan view from above and in a front elevation in partial section respectively.

To resolve the technical problem mentioned in the introduction to the present disclosure, in the context of the known art as described up to this point, the following provision is made. In the portion of the base structure 3 which faces the shaft 4 and which is close to this shaft when the elevator is in the low position at the start of the cycle, an aperture 15 is made and a supplementary shaft 17, of polygonal section for example, is mounted, by means of the end supports 16, 116, rotatably and parallel to the said shaft 4. The shaft 17 is connected by means of the reduction gearing 18 to a small electric motor 19 with electronic speed and phase control, for example one of the stepping type, fixed on a suitable extension of the support 16. Three cams 20, 21 and 22, most clearly seen in FIG. 5, are keyed to the shaft 17. Of these cams, the cam 20 which is outermost with respect to the elevator is in the shape of a sector with an angle of 180°, the next cam 21 is in the shape of a sector with an angle of 90°, and the last cam 22 is practically bar-shaped. All the cams have their rear faces aligned with each other, while their front faces are staggered in a graduated way with a lag of ninety degrees. The cams 20, 21, 22 are in such a position that their lever arms can interfere with the catches 10 of the brackets 5 which can be made inactive. When the elevator is in the low rest position, the cams 20, 21, 22 are in the condition shown in FIG. 1 in which they do not interfere with any of the catches 10.

Figure 6:
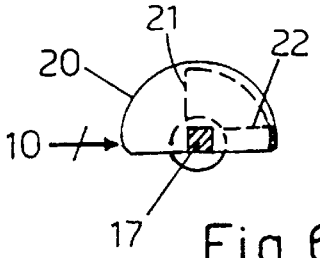
FIGS. 6, 7 and 8 are schematic illustrations of the various operating positions of the cams of the device in question.
Figure 7:
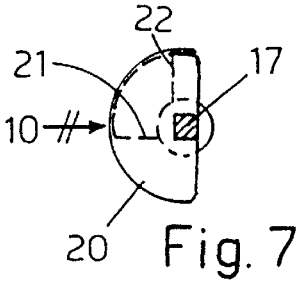
Figure 8:
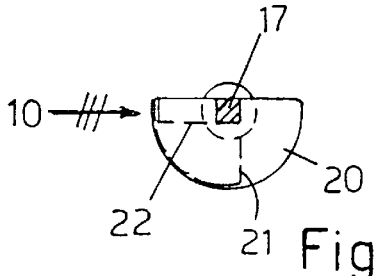

If the dimensions of the product to be packaged require that the outermost bracket, indicated by 5' in FIG. 3, be made inactive before the elevator rises, the shaft 17 is made to rotate through ninety degrees in the anticlockwise direction as seen by a person looking at FIG. 1, so that the cam 20 interacts with the catch 10 of the bracket 5', while the cams 21, 22, although they also rotate through ninety degrees, remain in a position of non-interference with the corresponding catches, as illustrated in the diagram in FIG. 6. The arrow 10 indicates the point of contact of the cams with the catches 10. If, however, the first and second brackets, indicated by 5' and 5" in FIG. 3, have to be inactivated, the shaft 17 is made to rotate through 180°, with the consequent activation of the cams 20 and 21 which interact with the corresponding catches 10, while the cam 22 is disposed with an upward orientation and still in the passive position, as illustrated in the diagram in FIG. 7. If, however, all three brackets indicated by 5', 5" and 5'" have to be inactivated, the shaft 17 is made to rotate through 270° so that all three cams 20, 21, 22 interact with the corresponding catches 10 and inactive the said brackets as soon as the elevator starts to rise, as illustrated in the diagram in FIG. 8. Before the elevator returns to the low rest position, the shaft 17 is returned to the angular position for the start of the cycle as shown in FIG. 1, with the cams 20, 21, 22 all in the inactive position, so that the catches of the brackets inactivated in the preceding cycle can be reset when the said brackets interact with the corresponding stops 14 shown in FIG. 1.

The shaft 17 has keyed to it an appendage 23 which interacts with a sensor 24, of the optoelectronic type for example, fixed to the structure 3, which signals to the processor of the packaging machine the angular position assumed from time to time by the cams associated with the said shaft, and also the rest position.

We claim:

1. An elevator for a packaging machine, movable from a bottommost position at which the elevator is loaded with an article to be packaged to a top position at which the article is wrapped inside a packaging, said elevator comprising a plurality of brackets (5), some of which may not be required to support the article, mounted on and projecting from a support shaft (4), at least one of said brackets being mounted so that it can oscillate on said shaft and said bracket carrying a retaining member (10–11) which, when the bracket is in an article supporting position, interacts with a fixed cooperating member (12, 112) to keep said bracket in said supporting position in an active position, while when the retaining member is removed from the fixed cooperating member said bracket oscillates out of said supporting position and is brought into an inactive position as soon as the elevator rises, characterized in that it comprises means of selectively and automatically disabling the retaining means (10, 11) of the brackets not required to support the article to be packaged, while the elevator is still in the bottommost position.

2. An elevator according to claim 1, in which each retaining member comprises a pivoted sprung catch (10–11) which, when the bracket is in the article supporting position, interacts with a step (112) of a cam (12) fixed on said shaft, to keep said bracket in the supporting position and in the active position, while when the catch is removed from said cam said bracket oscillates out of said supporting position and is brought into an inactive position for the purposes of the packaging as soon as the elevator rises, the inactivated brackets being made to interact, in the descending phase of the elevator, with stops (14) which return them to the supporting position by resetting the corresponding catches (10), characterized in that it comprises means of selectively and automatically disabling the catches of the brackets not required to support the article to be packaged, while the elevator is still in the bottommost position, in such a way as to prevent the subjection of the elevator to undesired vibrations during the raising travel, this condition being maintained at least during the first part of the rising travel of the elevator and said means then being made to be inactivated to leave the catches free, so that when the elevator returns to the bottommost position for the start of the cycle, the previously inactivated brackets are reset.

3. An elevator according to claim 2, in which the means which carry out the selective inactivation of the brackets are mounted on the base structure (3) of the machine, next to the elevator when the latter is in the bottommost position.

4. An elevator according to claim 3, in which the means which carry out the selective inactivation of the brackets comprise corresponding cams (20, 21, 22) of varying angular extent, one being disposed next to each catch, keyed to a common shaft (17) parallel to the shaft (4) which supports said brackets and which is supported rotatably by the base (3) of the machine and is connected to a motor (18–19) which is also fixed to said base and controlled by a processor governing the packaging machine.

5. An elevator according to claim 4, in which there is fixed on the shaft (17) with the cams (20, 21, 22) a radial appendage (23) which interacts with a fixed optoelectronic sensor (24) which signals to the processor of the machine the angular position of the said shaft.

6. An elevator according to claim 5, in which the cams (20, 21, 22) operating the catches of the inactivatable brackets of the elevator have, starting from the outermost cam (20), the shape of a sector with an angular extent of 180°, the shape of a sector with an angular extent of 90°, and the shape of a bar, these cams having their rear faces aligned with each other, while their front faces are staggered with respect to each other, in a graduated way, with a lag of 90°, all of the said cams, when in the rest position, being made to face away from the catches so that they do not interfere with them, while for the inactivation of the brackets of the elevator the said cam shaft is made to rotate with angular displacements of 90° or multiples of 90°.

7. An elevator according to claim 6, in which the processor governing the packaging machine is designed so that, after each rising travel of the elevator, the shaft (17) with the cams for inactivating the brackets is returned to the rest position, with all the cams inactivated, before the elevator returns to the bottommost position.

* * * * *